US006446284B1

(12) United States Patent
Yang

(10) Patent No.: US 6,446,284 B1
(45) Date of Patent: Sep. 10, 2002

(54) STRUCTURE FOR 4-IN-1 COMFORTER ASSEMBLY

(76) Inventor: Chu Yuan Yang, No. 1, Alley 38, Lane 365, Sec. 1, Tu Cheng City, Taipei Hsien (TW)

( * ) Notice: Subject to any disclaimer, the term of this patent is extended or adjusted under 35 U.S.C. 154(b) by 0 days.

(21) Appl. No.: 09/578,352

(22) Filed: May 24, 2000

(30) Foreign Application Priority Data

Nov. 20, 1999 (TW) ..... 88219785 U

(51) Int. Cl.[7] ..... A47G 9/04
(52) U.S. Cl. ..... 5/502; 5/482; 5/501; 5/923
(58) Field of Search ..... 5/502, 501, 482, 5/500, 923

(56) References Cited

U.S. PATENT DOCUMENTS 5,070,561 A * 12/1991 Keidser ..... 5/502
5,321,862 A * 6/1994 Campbell ..... 5/502

* cited by examiner

*Primary Examiner*—Alexander Grosz
(74) *Attorney, Agent, or Firm*—Dorsey & Whitney LLP

(57) ABSTRACT

An improved structure for a 4-in-1 comforter assembly comprises a top cover, a comforter, a frame cover, a bottom cover and fastening means that connect the top cover, the comforter, the frame cover and the bottom cover together. The structure allows one to readily replace any of the top cover, the comforter, the frame cover and the bottom cover.

11 Claims, 7 Drawing Sheets

(a)

(b)

(c)

STRUCTURE FOR 4-IN-1 COMFORTER ASSEMBLY

FIELD OF THE INVENTION

The present invention relates generally to a comforter and its covers, and in particular to an improved structure for a 4-in-1 comforter assembly.

BACKGROUND OF THE INVENTION

It is known that when a conventional comforter is packed into a bag-typed cover, the result may be an unevenness of the comforter in the cover. Further, it is also an undesirable experience that the comforter is pulled out of and put into the cover when replacing the cover. Furthermore, a conventional cover often accumulates cotton fibers therein that are difficult to remove, and after the cover is washed, drying can take a long time.

Comforter covers are one of the best home textiles and their beautiful patterns are good for brightening a bedroom or changing the ambience. Also, a comforter with its covers is one of the most common personal commodities. New-tech cloth aimed at improving human health is continuously being developed, and it will be beneficial for people if the new-tech cloth is well utilized.

There is a need for an improved structure for a 4-in-1 comforter assembly, preferably one allowing the top cover for the comforter to be readily replaced with a top cover having an aesthetic pattern, for example an Indian-weave pattern. Further there is a need for a comforter assembly that enables ready replacement of the comforter with a comforter having a different fill material, down or a wool blanket, for example. Further there is a need for a comforter assembly in which the bottom cover is readily replaced, for example with a cover finished by a special process such as anti-mycotoxin or anti-bacterial.

The present invention provides such a comforter assembly.

SUMMARY OF THE INVENTION

The present invention provides an improved structure for a 4-in-1 comforter assembly comprising a top cover, a comforter, a frame cover, a bottom cover and fastening means, whereby the fastening means are used to connect the top cover, the comforter, the frame cover and the bottom cover together.

In accordance with a preferred embodiment of the present invention, an improved structure for 4-in-1 comforter assembly is constructed such that:

a top cover in rectangular form includes four slots arranged respectively in four corners thereof;

a comforter in rectangular form includes four outward loops, the outward loops being arranged respectively at both ends of each of two longitudinal sides of the comforter;

a frame cover in a hollow, rectangular form having a C-shaped cross-section of an inward concave includes an outer edge and two inner edges, the outer edge being provided with four through holes and four inward loops, the through holes being arranged respectively at both ends of each of two longitudinal sides of the frame cover, each of the inward loops being provided respectively across one of the through holes in the concave of the frame cover, and each of the inner edges of the frame cover being provided with tube-shaped and flat extensions having slots;

a bottom cover in rectangular form includes four outward loops and four fasteners, the outward loops being arranged respectively at both ends of each of two longitudinal sides of the bottom cover, and each of the fasteners being provided correspondingly adjacent to one of the outward loops; and the fastening means includes four fastening elements;

whereby the comforter is edged by the frame cover and laid on the bottom cover, each side of the top cover is inserted between the tube-shaped extension and the flat extension of one of the inner edges of the frame cover, and the upper portion including the two outward loops, of the bottom cover and the lower portion including the other two outward loops, of the bottom cover are folded up respectively against the upper and lower portions of the frame cover such that one end of each of the fastening elements is used correspondingly to hold one of the outward loops of the comforter, one of the inner loops of the frame cover, and one of the outward loops and one of the fasteners of the bottom cover together, and the other end of each of the fastening elements is used correspondingly to hold one of the slots of the top cover and the slots included in the tube-shaped and flat extensions of the frame cover.

The bottom cover includes two first connecting sections each located substantially between the two fasteners on one of two longitudinal sides of the bottom cover, and the frame cover includes two second connecting sections each located substantially on the outer edge between the two through holes on one of two longitudinal sides of the frame cover such that each of the first connecting sections is attached correspondingly to one of the second connecting sections.

The top cover includes a plurality of first holes located along the circumference thereof, and the frame cover includes a plurality of second holes arranged in the tube-shaped and flat extensions of each of the inner edges thereof such that each of the first holes and at least one of the second holes corresponding thereto are held together by one of fastening parts.

Each of the fastening elements includes a solid attaching portion at one end and a hollow attaching portion at the other end, the hollow attaching portion including a tongue having a female button such that the female button can be fixed correspondingly to a male button arranged in an intermediate portion of each of the fastening elements.

Additionally, in accordance with another embodiment of the present invention, an improved structure for 4-in-1 comforter assembly is constructed by that a top cover in rectangular form includes a plurality of first holes arranged along each of two longitudinal sides thereof;

a frame cover in hollow, rectangular form and with a C-shaped cross-section of an inward concave includes an outer edge and two inner edges, the outer edge being provided with a flat extension on each of two longitudinal sides thereof, having a plurality of second holes corresponding respectively to a plurality of third holes located on the area adjacent to the flat extension;

a bottom cover in rectangular form includes four outward loops, four fasteners and a plurality of fourth holes, the outward loops being arranged respectively at both ends of each of two longitudinal sides of the bottom cover, each of the fasteners being provided correspondingly adjacent to one of the outward loops, and the fourth holes being provided between the two fasteners on each of two longitudinal sides of the bottom cover; and the fastening means includes a plurality of fastening parts linked by two strings respectively in two series;

whereby a comforter is edged by the frame cover, laid on the bottom cover, and covered atop by the top cover such that one of the first holes, one of the second holes, one of the third holes and one of the fourth holes correspondingly to each other are fastened by one of the fastening parts, and the upper portion including the two outward loops, of the bottom cover and the lower portion including the other two outward loops, of the bottom cover are folded up respectively against the upper and lower portions of the frame cover such that each of the outward loops is secured correspondingly by one of the fasteners.

Other features and advantages of the invention will appear from the following description in which the preferred embodiments have been set forth in detail, in conjunction with the accompanying drawings.

DETAILED DESCRIPTION OF THE PREFERRED EMBODIMENTS

Figure 1:
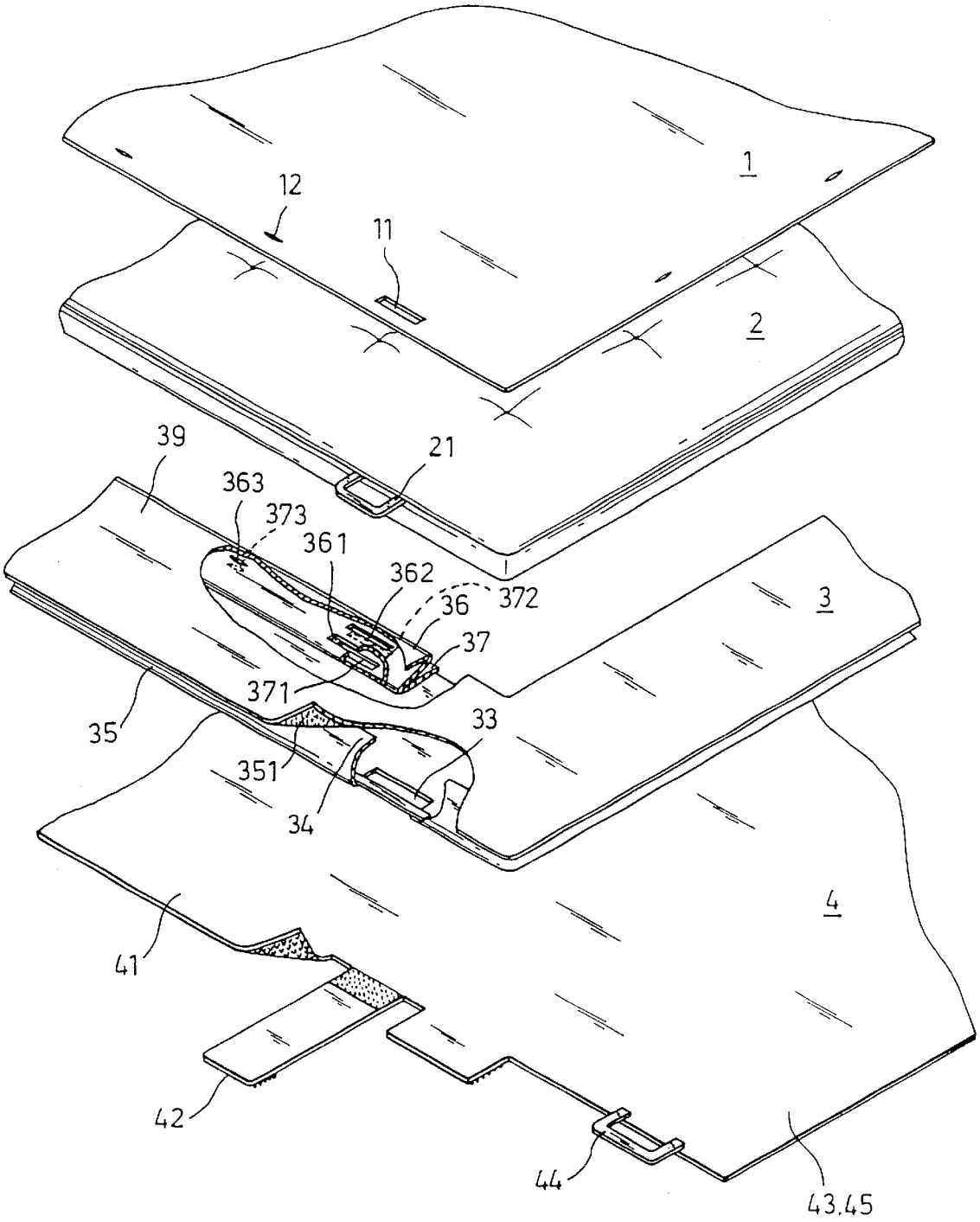
FIG. 1 shows a comforter assembly according to an preferred embodiment of the present invention before assembling.
Figure 2:
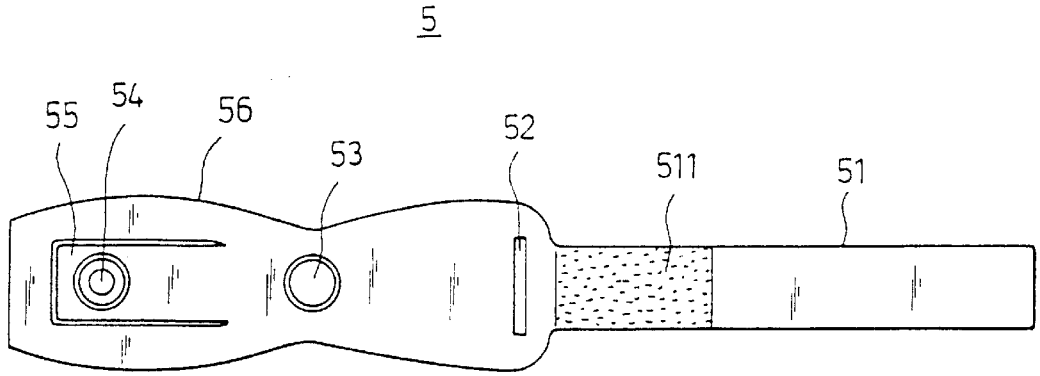
FIG. 2*a* shows a top view of one of fastening elements according to the preferred embodiment of the present invention in FIG. 1.
FIG. 2*b* shows a bottom view of one of the fastening elements in FIG. 2*a*.
FIG. 2*c* shows a side-sectional view of one of the fastening elements in FIG. 2*a*.
Figure 2:
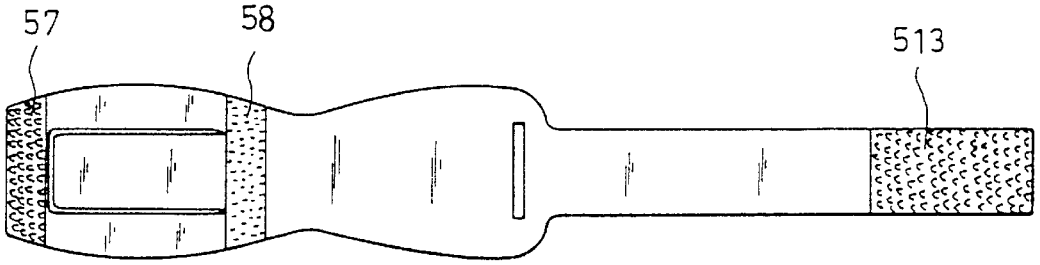
Figure 2:
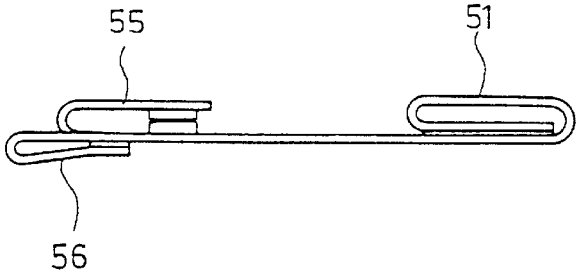

According to a preferred embodiment of the present invention, an improved structure for a comforter assembly comprises a top cover 1, a comforter 2, a frame cover 3, a bottom cover 4 and four fastening elements 5, as shown in FIG. 1, illustrating one quadrant of the comforter assembly, and FIG. 2*a*.

The top cover 1, in rectangular form, includes four slots 11 arranged respectively in four corners of the top cover. The top cover 1 further includes a plurality of first holes 12 located along the circumference thereof.

The comforter 2, in rectangular form, includes four outward loops 21. The outward loops 21 are arranged respectively at both ends of each of two longitudinal sides of the comforter 2.

As shown in FIG. 1, the frame cover 3, in hollow, rectangular form and with a C-shaped cross-section of an inward concave, includes an outer edge 35 and two inner edges 39. The outer edge 35 is provided with four through holes 33 and four inward loops 34. The through holes 33 are arranged respectively at both ends of each of two longitudinal sides of the frame cover 3. Each of the inward loops 34 is provided respectively across one of the through holes 33 in the concave region of the frame cover 3. As shown in FIG. 1, each of the inner edges 39 is provided with a tube-shaped extension 36 having slots 361 and 362 each located at both end of each of two longitudinal sides of one of the inner edges 39, and a flat extension 37 having slots 371 and 372 each located at both end of each of two longitudinal sides of one of the inner edges 39. The frame cover 3 further includes a plurality of button holes 363 and 373 arranged respectively in the tube-shaped extension 36 and the flat extension 37 of each of the inner edges thereof. Location of each of the button holes 363 corresponds to one of the button holes 373. Both the surfaces of the frame cover can be used alternatively, and can be made of different materials for different seasons and in different patterns, thereby matching with different top covers. Further, the frame cover can vary in hollow form, such as circular, elliptic and diamond.

The bottom cover 4, in rectangular form, includes four outward loops 44 and four fasteners 42. The outward loops 44 are arranged respectively at both ends of each of two longitudinal sides of the bottom cover 4. Each of the fasteners 42 corresponds to one of the outward loops 44 adjacent thereto.

FIGS. 2*a*, 2*b* and 2*c* depict respectively the top, bottom and side-sectional views of one of the fastening elements 5. As shown in these figures, each of the fastening elements 5 includes a solid attaching portion 51 at one end and a hollow attaching portion 56 at the other end. The solid attaching portion 51 is provided with a loop tape 513 at one end and a hook tape 511 at the other end wherein the loop tape 513 and the hook tape 511 are respectively on opposite sides. As shown in FIG. 2*b*, the hollow attaching portion 56 is provided with a loop tape 57 at one end and a hook tape 58 at the other end. The hollow attaching portion 56 further includes a tongue 55 having a female button 54. The female button 54 can be fixed correspondingly to a male button 53 arranged in an intermediate portion of the fastening elements 5. The intermediate portion is provided with a slot 52 next to the solid attaching portion 51.

Figure 3:
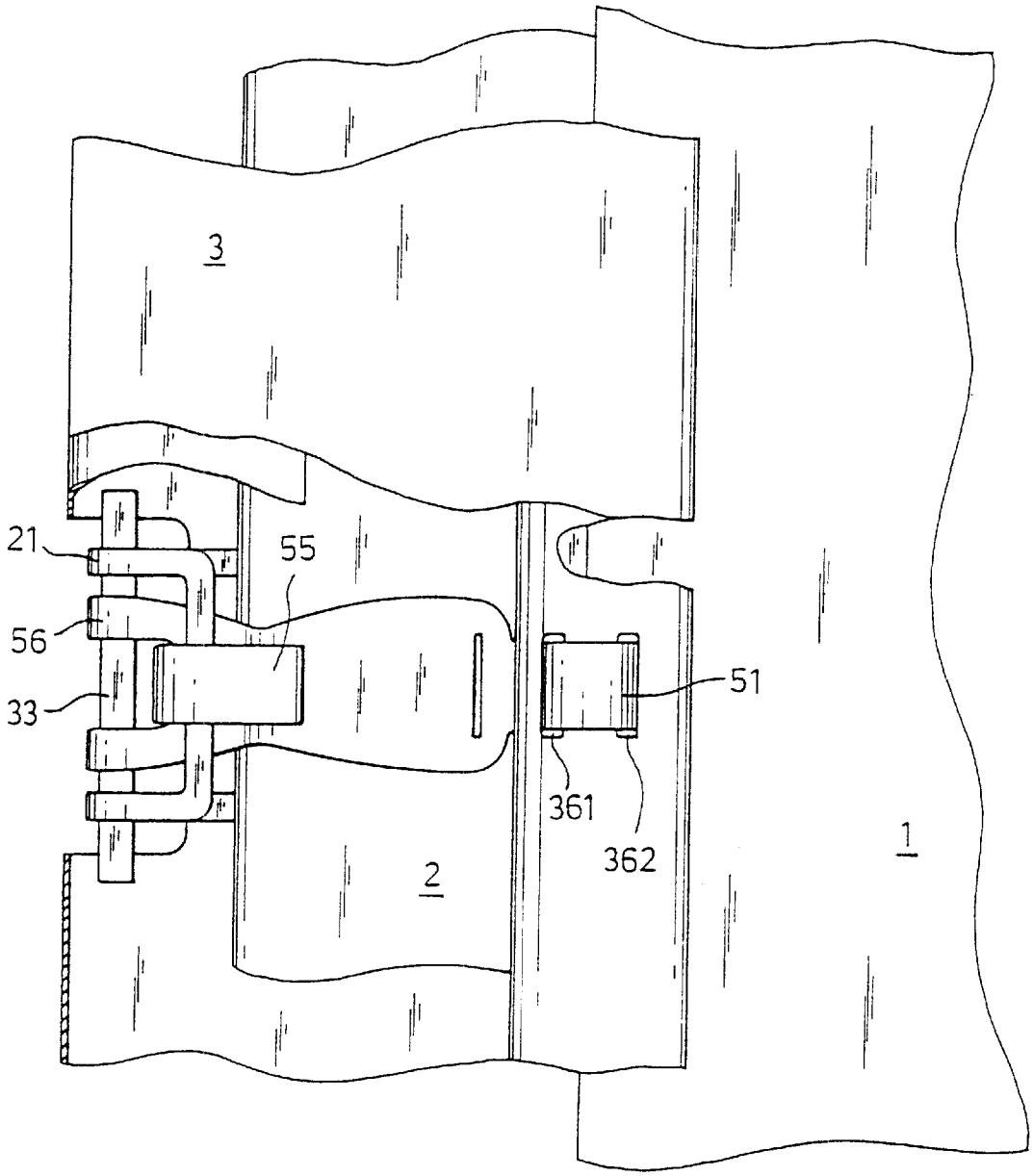
FIG. 3 shows a partially cut away, top view of the comforter assembly in FIG. 1 before the upper and lower portions of a bottom cover are folded up.
Figure 4:
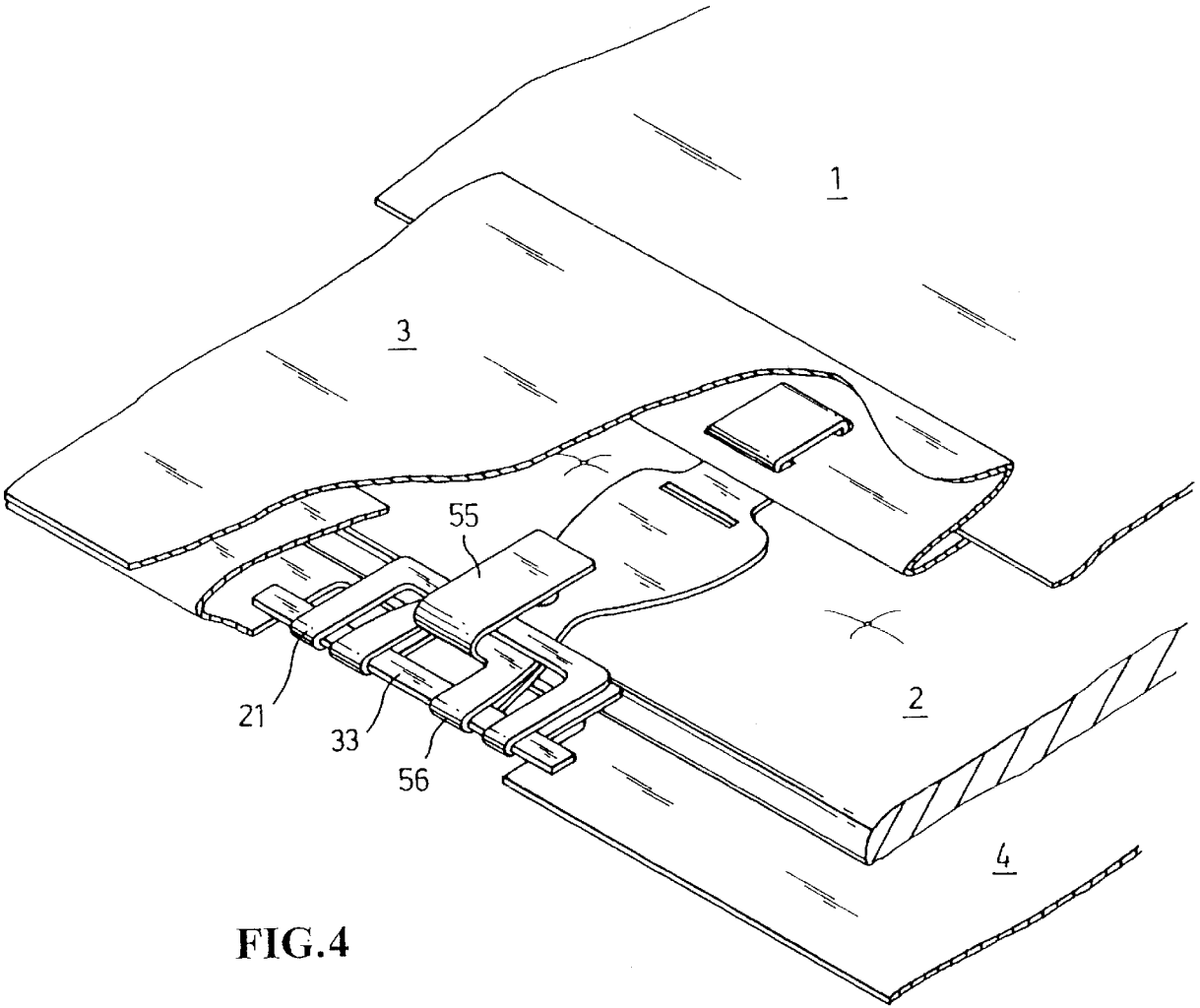
FIG. 4 shows a partially cut away, perspective view of the comforter assembly in FIG. 1 before the upper and lower portions of the bottom cover are folded up.
Figure 5:
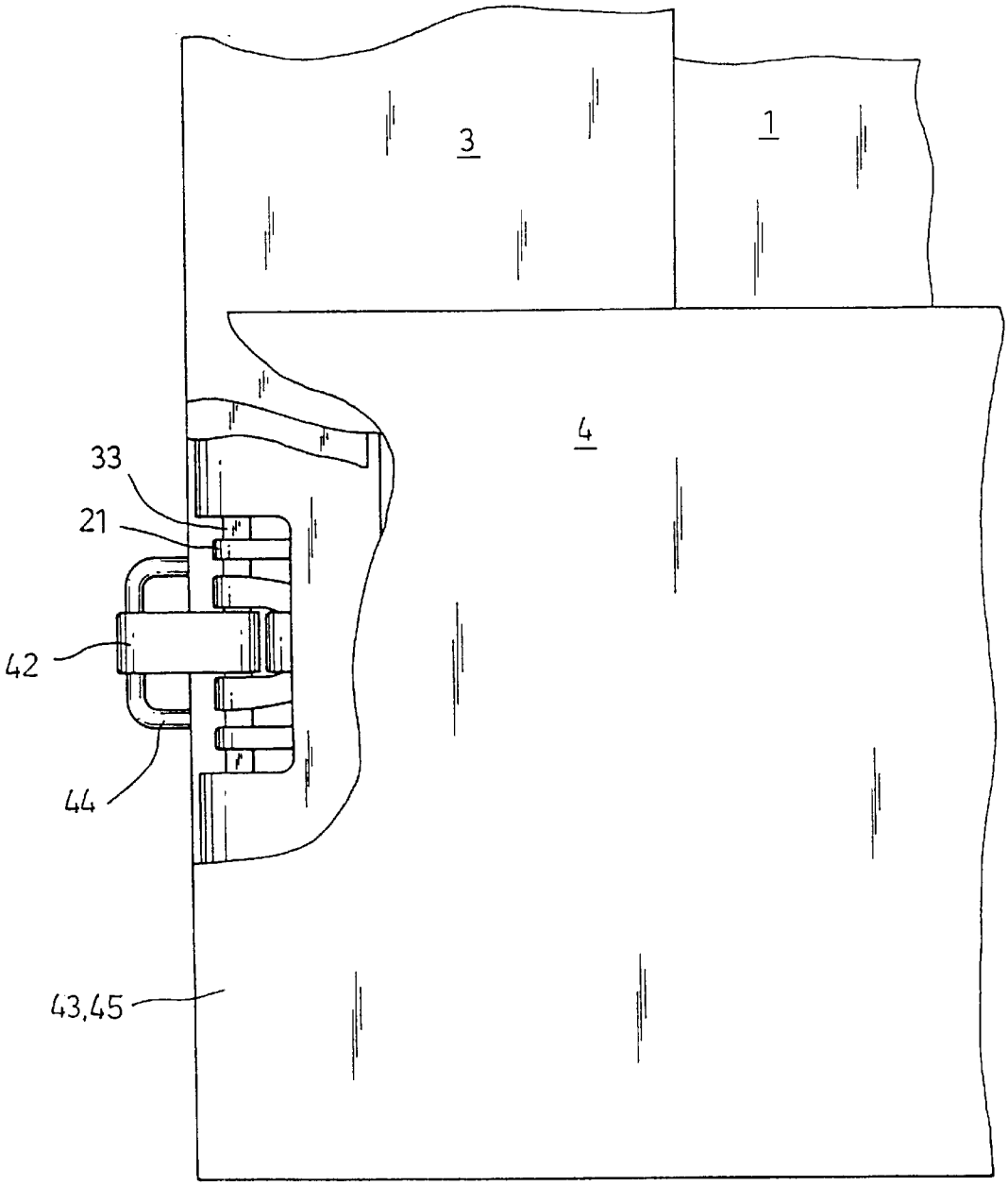
FIG. 5 shows a partially cut away, top view of the comforter assembly in FIG. 1 after the upper and lower portions of the bottom cover are folded up.

In order to obtain the comforter assembly of the present invention, as shown in FIGS. 3 and 4, the comforter 2 is edged by the frame cover 3 and laid on the bottom cover 4. Each side of the top cover 1 is inserted between the tube-shaped extension 36 and the flat extension 37 of one of the inner edges 39 of the frame cover 3, and the upper portion 43 including the two outward loops 44, of the bottom cover 4 and the lower portion 45 including the other two outward loops 44, of the bottom cover 4 are folded up respectively against the upper and lower portions of the frame cover 3.

Thereafter, as shown in FIGS. 3 and 4, from the inward concave region of the frame cover 3, the outward loops 21 of the comforter 2 are respectively inserted upwards into the inward loops 33 of the frame cover 3 from the underneath. The hollow attaching portion 56 of each of the fastening elements 5 is inserted downwards into one of the inward loops 33 of the frame cover 3 such that the loop tape 57 is attached to the hook tape 58, and the tongue 55 is correspondingly inserted upwards into one of the inward loops 21 of the comforter 2 from the underneath. As a result, the female button 54 is fastened onto the male button 53. The solid attaching portion 51 is inserted into the slots in sequence of 371, 361, 362, 11 and 372 when the male button 53 faces up, such that the loop tape 513 is attached to the hook tape 511. If the male button 53 faces down, the inserting sequence is 371, 361, 362, 11, 372 and 52 (not shown).

As shown in FIG. 1, the bottom cover 4 further includes two first connecting sections 41 each located substantially between two of the fasteners 42 on one of two longitudinal sides of the bottom cover 4. The frame cover 3 further includes two second connecting sections 351 each located on the outer edge 35 substantially between the two through holes 34 on one of two longitudinal sides of the frame cover 3 such that each of the first connecting sections 41 is attached correspondingly to one of the second connecting sections 351. Thereafter, the upper portion 43 and the lower portion 45 of the bottom cover 4 are folded up respectively against the upper and lower portions of the frame cover 3. The result is that each of the fasteners 42 having hook and loop tapes respectively disposed at opposite ends on one side thereof is inserted correspondingly into one of the inward loops 33 and one of the outward loops 44 from the underneath such that the hook and loop tapes on each of the fasteners 42 are attached to each other.

Figure 6:
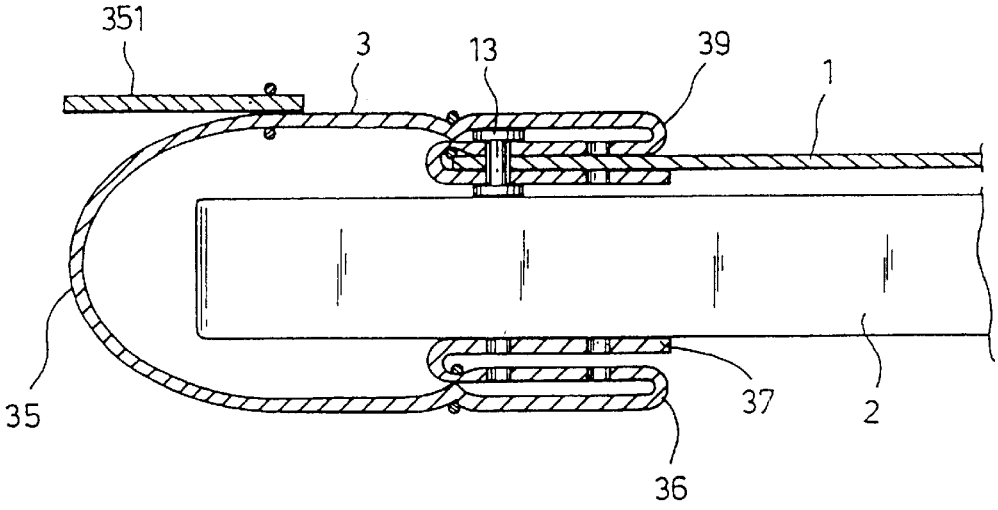
FIG. 6 shows a partially cut away, sectional view taken along a line across one longitudinal side of the comforter assembly in FIG. 1 after assembling.
Figure 7:
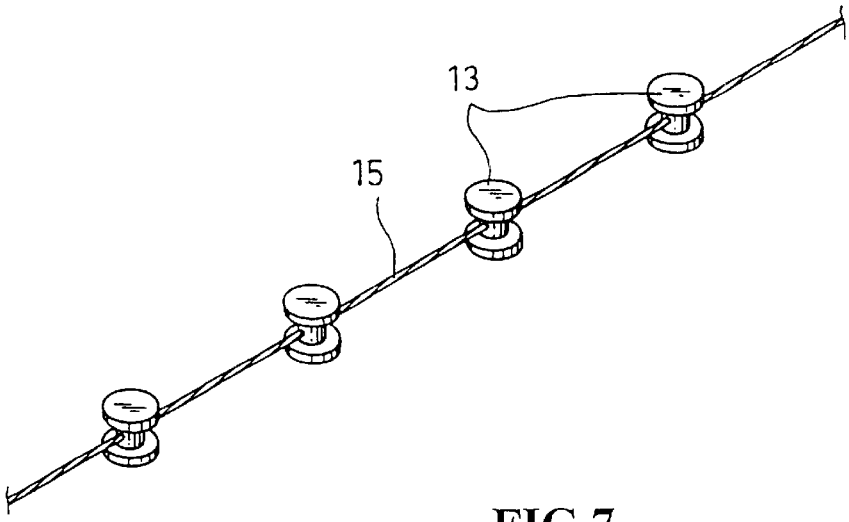
FIG. 7 is a perspective view showing fasteners used in FIG. 6, linked by a string.

As shown in FIGS. 6 and 7, the top cover 1 further includes a plurality of button holes 12 located along the circumference thereof and each of the button holes 12 corresponds to one of the button holes 363 and one of the button holes 373 such that each of the button holes 12 is fastened correspondingly to one of the button holes 363 and one of the button holes 373 by one of buttons 13 respectively linked by strings 15. Thereby, the comforter assembly in accordance with the first embodiment of the present invention is obtained.

Further, the improved structure for 4-in-1 comforter assembly in accordance with the above preferred embodiment of the present invention can be used for a comforter without the outward loops.

Figure 8:
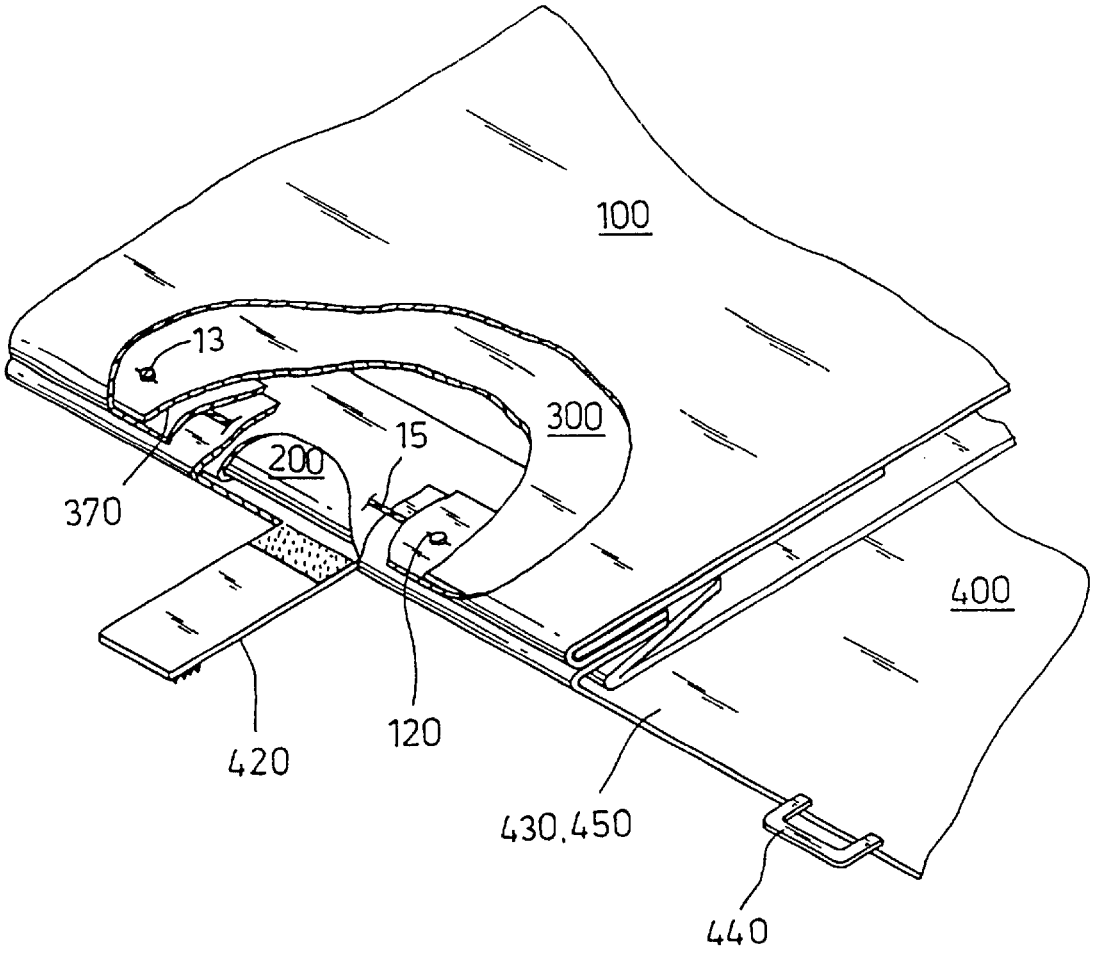
FIG. 8 is a partially cut away, perspective view of an improved structure for 4-in-1 comforter assembly in accordance with another embodiment of the present invention.

FIG. 8 shows one quadrant of an improved structure for 4-in-1 comforter assembly in accordance with another embodiment of the present invention. As shown in FIG. 8, the comforter assembly is constructed with a top cover 100 in rectangular form that includes a plurality of button holes 120 arranged along each of two longitudinal sides thereof. The assembly further includes a frame cover 300 in hollow, rectangular form having a C-shaped cross-section of an inward concave region that includes an outer edge and two inner edges. The outer edge is provided with a flat extension 370 on each of two longitudinal sides thereof, and has a plurality of button holes (not shown) whose locations correspond respectively to a plurality of button holes (not shown) located on the area adjacent to the flat extension 370. The assembly further includes a bottom cover 400 in rectangular form having four outward loops 440, four fasteners 420 and a plurality of button holes (not shown). The outward loops 440 are arranged respectively at both ends of each of two longitudinal sides of the bottom cover 400. Each of the fasteners 420 is provided correspondingly adjacent to one of the outward loops 440, and the button holes are provided between the two fasteners 420 on each of two longitudinal sides of the bottom cover 400. The fastening means includes a plurality of buttons 13 linked by two strings 15 respectively in two series.

As shown in FIG. 8, a comforter 200 is edged by the frame cover 300, laid on the bottom cover 400. On the top, the comforter is covered by the top cover 100 such that there is alignment between one of the button holes 120, one of the button holes of the flat extension 370, one of the button holes located on the area adjacent to the flat extension 370 and one of the button holes of the bottom cover 400. Fastening occurs using one of the buttons. The upper portion 430 includes the two outward loops 440, of the bottom cover 400, and the lower portion 450 includes the other two outward loops 440. Upward folding, of the bottom cover 400 against the upper and lower portions of the frame cover 300 is such that each of the outward loops 440 is secured correspondingly by one of the fasteners 420. Each of the fasteners 420 of the bottom cover 400 is provided with loop tape and hook tape respectively at opposite ends on one surface thereof.

Various features of the present invention have been particularly shown and described in connection with the figures. However, it must be understood that these particular arrangements are merely exemplary, and that the present invention is to be given its fullest interpretation within the scope of the appended claims.

What is claimed is:

1. A structure for a 4-in-1 comforter assembly, comprising:

a top cover (1) having a rectangular form with four corners, each of said corners defining a slot (11);

a comforter (2) having a rectangular form having two longitudinal edges and including four outwardly-extending loops (21), two of said outwardly-extending loops being disposed on each end of said two longitudinal edges;

a frame cover (3) having a hollow rectangular form with two longitudinal sides and a C-shaped cross-section that includes an inward concave region, two inner edges (39) that each include a tube-shaped extension (36) and a flat extension (37) defining slots (361, 362, 371, 372), and an outer edge (35) that defines four through holes (33) disposed respectively at each end of said two longitudinal sides of the frame cover (3), said frame cover further including four inwardly-extending loops (34) provided respectively across one of said through holes (33) in said concave region;

a bottom cover (4) having a rectangular form with two longitudinal sides and including four outwardly-extending loops (44) disposed respectively at each end of said two longitudinal sides of said bottom cover (4), and including four fasteners (42), each of said fasteners (42) disposed correspondingly adjacent one of said outwardly-extending loops (44); and means for fastening together said top cover (1), said comforter (2), said frame cover (3) and said bottom cover (4), said means for fastening including four fastening elements (5);

wherein said comforter (2) is edged by said frame cover (3) and laid-on said bottom cover (4), each side of said top cover (1) is inserted between said tube-shaped extension (36) and the flat extension (37) of one of said inner edges (39), and said upper portion including said two outwardly-extending loops (44), and said lower portion including remaining said outwardly-extending loops (44) are folded-up respectively against upper and lower portions of said frame cover (3) such that one end of each of said fastening elements (5) is used correspondingly to hold one of said outward loops (21) of the comforter (2), one of said inner loops (34) of the frame cover (3), and one of said outwardly-extending loops (44) and one of said fasteners (42) of said bottom cover (4) together, and a remaining end of each of said fastening elements (5) is used correspondingly to hold one of said slots (11) of said top cover (1) and slots (361, 362; 371, 372) defined in said tube-shaped extension (36) and in said flat extension (37) of said frame cover (3).

2. The structure for a 4-in-1 comforter assembly of claim 1, wherein:

said bottom cover (4) includes two first connecting sections (41) each disposed substantially between said two fasteners (42) disposed on one of said two longitudinal sides of said bottom cover (4); and said frame cover (3) includes two second connecting sections (351) each disposed substantially between said two through holes (33) on one of said two longitudinal sides of said frame cover (3);

wherein each of said first connecting sections (41) is attached correspondingly to one of said second connecting sections (351).

3. The structure for a 4-in-1 comforter assembly of claim 1, wherein:

said first connecting sections (41) include loop tape; and said second connecting sections (351) includes hook tape.

4. The structure for a 4-in-1 comforter assembly of claim 1, wherein:

each of said fasteners (42) of said bottom cover (4) includes loop tape and hook tape respectively at opposite ends on one surface thereof.

5. The structure for a 4-in-1 comforter assembly of claim 1, wherein:

said top cover (1) defines a plurality of first holes (12) disposed along a circumference thereof;

said inner edges (39) of said frame cover (3) includes a tube-shaped extension (36) and a flat extension (37); and said frame cover (3) defines a plurality of second holes (363; 373) disposed in said tube-shaped extension (36) and in said flat extension (37) such that each of said first holes (12) and at least one of said second holes (363, 373) corresponding thereto is retained together by one of said fastening parts (13).

6. The structure for a 4-in-1 comforter assembly of claim 1, wherein:

each of said fastening elements (5) includes a first end having a solid attaching portion (51), and includes a second end having a hollow attaching portion (52) that includes a tongue (55) with a female button (54);

wherein said female button (54) can be fixed correspondingly to a male button (53) disposed in an intermediate portion of each of said fastening elements (5).

7. The structure for a 4-in-1 comforter assembly of claim 1, wherein:

each of said fastening elements (5) includes a first end having a solid attaching portion (51) that includes one of loop tape and hook tape, and further includes a second end that includes, respectively, one of hook tape and loop tape.

8. The structure for a 4-in-1 comforter assembly of claim 1, wherein:

each of said fastening elements (5) includes a first end having a hollow attaching portion (52) that includes one of loop tape and hook tape, and further includes a second end that includes, respectively, one of hook tape and loop tape.

9. The structure for a 4-in-1 comforter assembly of claim 1, further including lengths of string linking said fastening parts (13).

10. A structure for a 4-in-1 comforter assembly comprising:

a top cover (100) having a rectangular form including two longitudinal sides and defining a plurality of first holes (120) disposed along each of said two longitudinal sides;

a comforter (200);

a frame cover (300) having a hollow rectangular form and a C-shaped cross-section that includes an inward concave region, two inner edges (39), and an outer edge (35), said outer edge including a flat extension (370) on each of two longitudinal sides thereof, and defining a plurality of second holes corresponding respectively to a plurality of third holes disposed on an area adjacent said flat extension (370);

a bottom cover (400) having a rectangular form with two longitudinal sides and including two pair of outwardly-extending loops (440) disposed one pair respectively at each end of said two longitudinal sides of said bottom cover, four fasteners (420), and defining a plurality of fourth holes, each of said fasteners (420) disposed correspondingly adjacent one of said outwardly-extending loops (440), and said fourth holes being defined between two said fasteners (420) on each of said two longitudinal sides of said bottom cover (400); and means for fastening, including a plurality of fastening parts (13) linked by two strings (15) respectively in two series;

wherein said comforter (200) is edged by said frame cover (300), and laid-on said bottom cover (400), and is covered atop by said top cover (100) such that one of said first holes (120), one of said second holes, one of said third hole and one of said fourth holes correspondingly to one another are fastened by one of said fastening parts (13), and said upper portion (430) including two of said outwardly-extending loops (440) and said lower portion (450) including a remaining two of said outwardly-extending loops (440) are folded-up respectively against upper and lower portions (430, 450) of said frame cover (400) such that each outwardly-extending loop (440) is secured correspondingly by one of said fasteners (420).

11. The structure for a 4-in-1 comforter assembly of claim 10, wherein each of said fasteners (420) of said bottom cover (400) is provided with loop tape and hook tape respectively at opposite ends on one surface thereof.

* * * * *